United States Patent [19]

Hoffman

[11] 3,985,412

[45] Oct. 12, 1976

[54] GROUNDING ELECTRICAL ADAPTER

[75] Inventor: Ernest Gerhard Hoffman, Middlefield, Conn.

[73] Assignee: Harvey Hubbell Incorporated, Orange, Conn.

[22] Filed: Jan. 29, 1976

[21] Appl. No.: 653,342

[52] U.S. Cl. ..... 339/14 RP; 339/166 R

[51] Int. Cl.[2] ..... H01R 3/06

[58] Field of Search ..... 339/14 R, 14 P, 14 RP, 339/166 R

[56] References Cited

UNITED STATES PATENTS

| | | | |
|---|---|---|---|
| 3,299,390 | 1/1967 | Eckelkamp | 339/14 RP X |
| 3,363,215 | 1/1968 | Smith | 339/14 R |
| 3,739,317 | 6/1973 | Wise | 339/14 P |
| 3,775,727 | 11/1973 | Wise | 339/14 R |

*Primary Examiner*—Roy Lake
*Assistant Examiner*—E. F. Desmond
*Attorney, Agent, or Firm*—Jerry M. Presson

[57] ABSTRACT

A grounding electrical adapter for connecting a three-wire plug to a two-wire receptacle connects electrically the grounding blade of the plug to the grounded mounting screw of the receptacle plate, without removing that screw, in a novel manner which not only assures good electrical contact to ground and good mechanical connection to the receptacle but also tends to force a user to make a proper ground connection.

6 Claims, 9 Drawing Figures

FIG. 1A
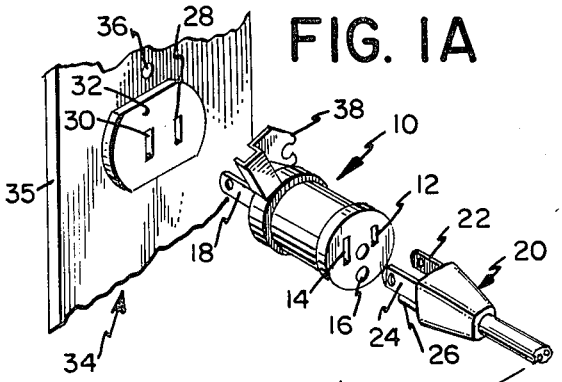
FIG. 1B
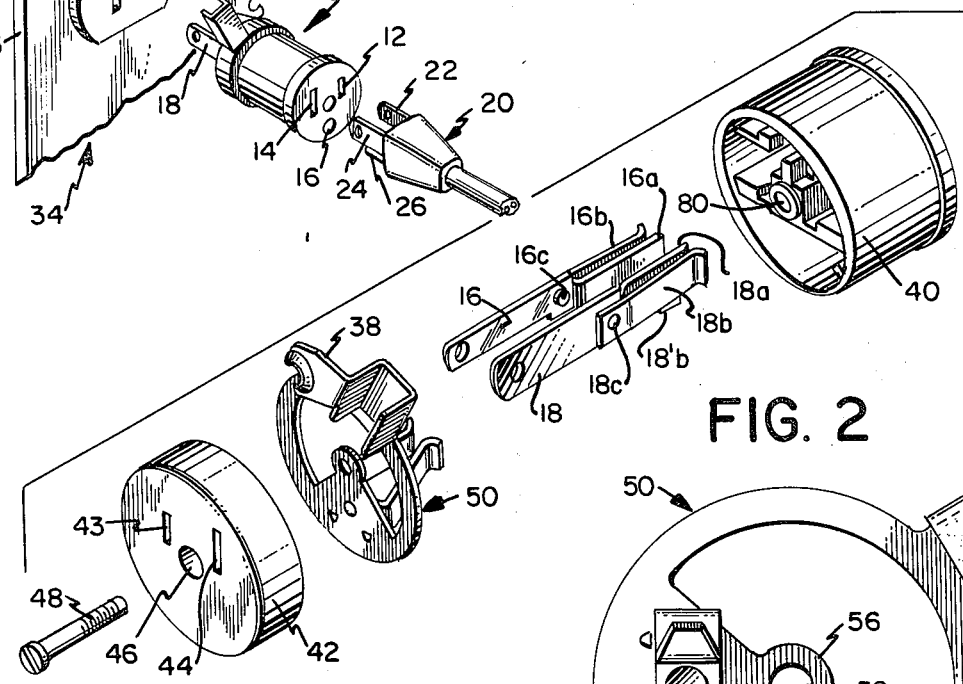
FIG. 2
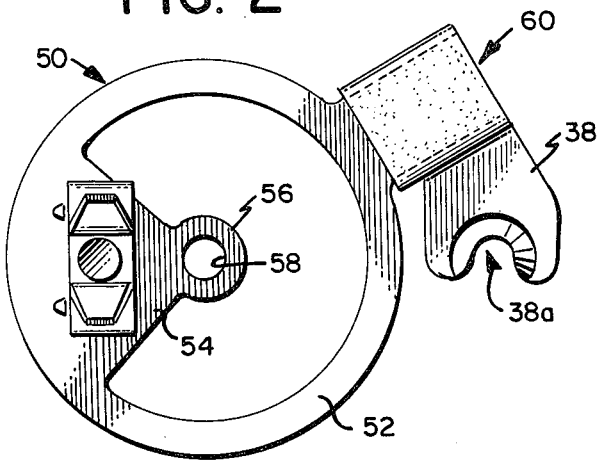
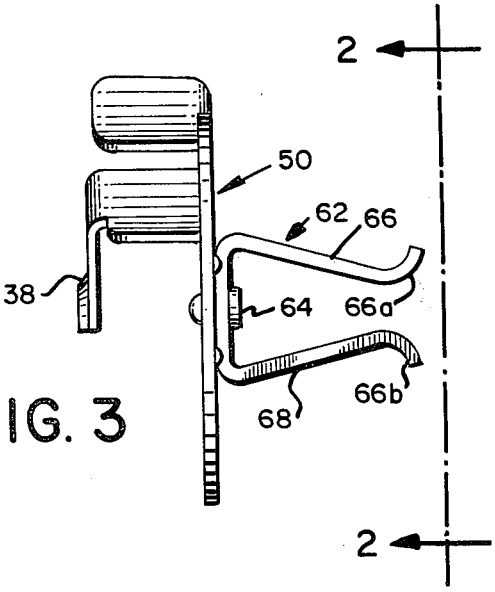
FIG. 3
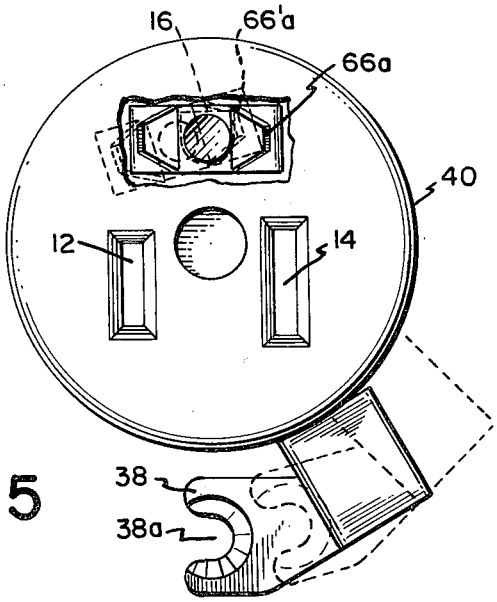
FIG. 5

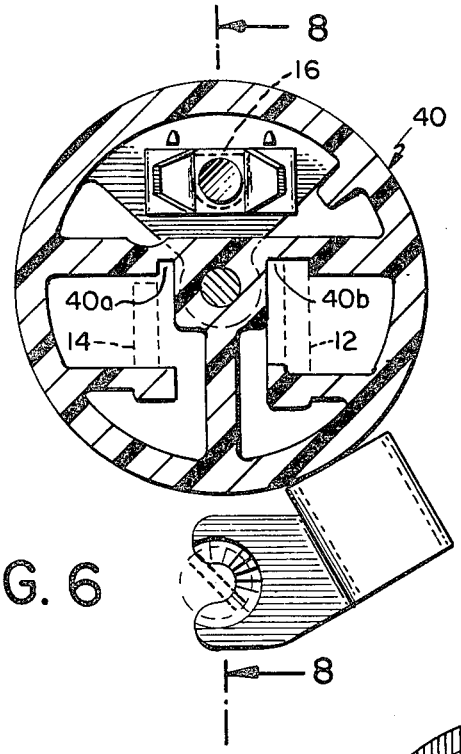
FIG. 6
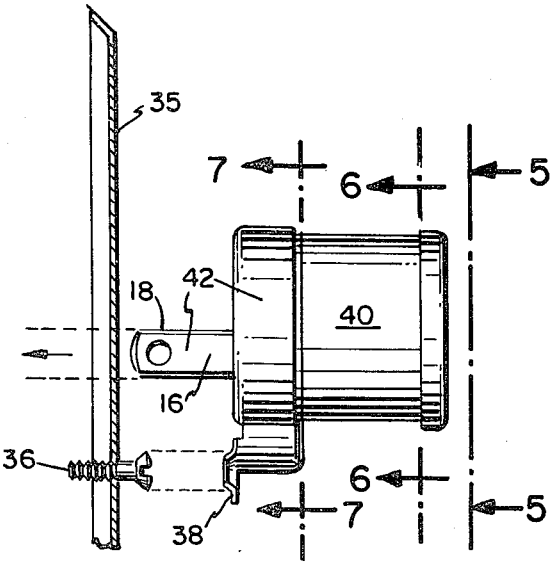
FIG. 4
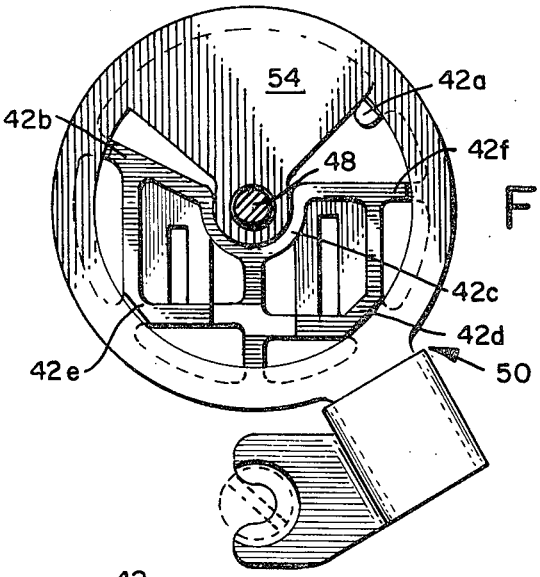
FIG. 7
FIG. 8
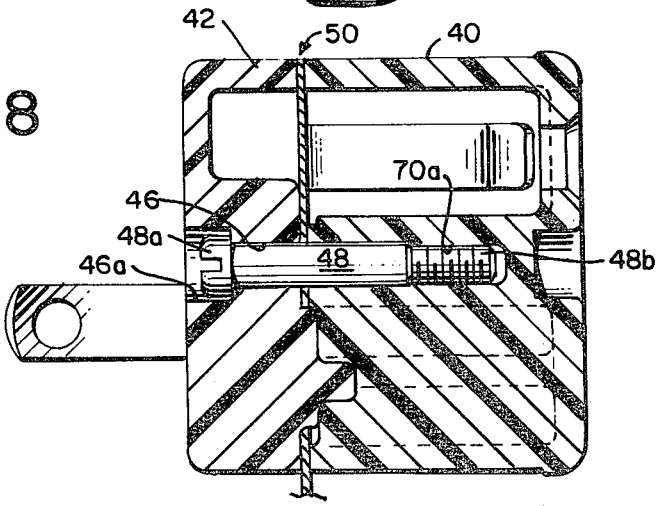

GROUNDING ELECTRICAL ADAPTER

BACKGROUND AND SUMMARY OF THE INVENTION

The invention relates to a grounding electrical adapter for coupling a grounding blade of an electrical plug to a grounded screw of an electrical receptacle, for example when couplin a three-blade grounding plug to a two-slot coupling of a two-wire receptacle.

Much of the present day electrical equipment uses three-wire cords having three-wire plugs adapted for plugging into three-wire receptacles. Two of the wires are the powerline wires (a hot and neutral wire) and the third wire is a grounding wire typically connected to any exposed metal portions that the equipment may have. One purpose of the grounding wire is to maintain such exposed portions grounded and thus reduce hazard in the eventuality that an exposed electrically conductive portion becomes connected to the hot side of the powerline. While many receptacles are of the three-wire type, there are some, primarily in older buildings, which are of the two-wire type and do not have a grounding female terminal for receiving the grounding blade of a three-wire plug. It is possible to connect three-wire equipment to such two-wire receptacles by simply cutting off the grounding blade of the three-wire plug, or by replacing the three-wire plug with a two-wire plug, but this is obviously unsafe because it fails to make use of the safety afforded by the grounding wire.

The two-wire receptacles typically have a metal housing which is electrically grounded (through a metal conduit enclosing the two powerline wires, or through a separate, grounding conductor), and have a cover plate secured to that grounded housing by a metal screw. Based on this, there have been prior art adapters designed to electrically couple the grounding blade of a three-wire plug to that grounded screw. One commonly used adapter of this type has a back end where a three-blade plug can be plugged in, a front end having two blades for plugging into the outlet socket of a two-wire receptacle, and a wire coming off the side of the adapter and having at its free end a crimp terminal which can be connected to the grounded, plate-mounting screw of the receptacle by loosening or removing the screw, placing the crimp terminal under the screw and then tightening the screw to make electrical contact with the crimp terminal and to keep the crimp terminal in place against the cover plate of the receptacle. Other adapters of this type have a stiff metal strip coming off the side. The metal strip is similarly connected to the grounded screw of the receptacle, requiring however that the screw be completely removed and passed through an opening in the strip (U.S. Pat. No. 3,865,453).

There are additionally prior art techniques where the free end of a three-wire cord has a two-blade plug for plugging into a two-wire receptacle and a grounding wire comes off the side of the plug to be connected to the grounded screw of the receptacle (U.S. Pat. No. 3,072,873). In a similar prior art technique, the grounding wire of the equipment is connected to a metal pin coming off the side of a two-blade plug, and — as the plug is being plugged into the two-wire receptacle — the pin engages a metal spring-clip previously attached to the receptacle by the grounded screw (U.S. Pat. No. 3,349,360). There are also devices in which a three-blade plug is inserted into a three-wire receptacle and the grounding wire of the cord is additionally connected, for extra mechanical and electrical safety, to the grounded screw of the receptacle by a metal strip coming off the side of the plug (U.S. Pat. No. 3,381,258), as well as devices in which the neutral wire of a two-wire plug is additionally connected to the grounding female terminal of a three-wire receptacle, or to the grounded screw of a two-wire receptacle (U.S. Pat. No. 3,739,317).

There are various disadvantages with the above types of prior art adapters for coupling the grounding blade of a plug to the grounded screw of a receptacle, and particularly with the adapters for coupling a three-blade plug to a two-wire receptacle. For example, the grounding wire coming off the side of the common adapter is often not connected to the grounded screw of the receptacle because the user does not appreciate its significance, or because it is inconvenient at the time to connect it properly, or for other reasons. As another example, it may be inconvenient or dangerous to use adapters of the type which have a fixed metal strip coming off the side, because such adapters typically require that the grounded screw be completely taken out of the receptacle, which may displace the plate. The hazard of this is that the plate may make electrical contact with one or both blades of the plug or adapter which are partly plugged into the receptacle and at a dangerous potential.

This invention obviates problems of the type discussed above by providing an adapter which not only assures good electrical and mechanical contact to the receptacle, but also tends to force a user to make a convenient and proper ground connection. Moreover, the grounded screw of the receptacle plate does not have to be removed, but only has to be slightly loosened, thus completely obviating the electrical hazard and the inconvenience of having the receptacle plate come off its proper place.

The invented adapter has a grounding assembly moveable between an inoperative position and an operative position. When the grounding assembly is in its operative position, a grounding terminal of the assembly is aligned with the grounded screw of a receptacle into which the adapter is plugged, and a cord plug having a grounding blade may be plugged into the back end of the adapter. When the grounding assembly of the adapter is in its inoperative position, the grounding terminal of the assembly is offset from the grounded screw of a receptacle into which the adapter is plugged, and a back portion of the grounding assembly blocks the grounding blade of a cord plug from being plugged into the adapter. If an attempt is made to force the grounding blade of a plug into the adapter while the grounding assembly is in its inoperative position, the grounding assembly moves from its inoperative to its operative position, due to a cam action between the leading end of the grounding blade being inserted into the adapter and a suitable cam surface at the back end of the grounding assembly, so as to automatically align the grounding terminal of the adapter with the grounded screw of a receptacle where the adapter is plugged in.

BRIEF DESCRIPTION OF THE DRAWINGS

FIG. 1*a* is a perspective view of a portion of a typical two-wire receptacle, an embodiment of the invented adapter and a typical three-wire plug.

FIG. 1*b* is an exploded perspective view of an embodiment of the invented adapter.

FIG. 2 is a plan view of a grounding assembly forming a part of the adapter of FIGS. 1*a* and 1*b*, as viewed from the righthand side of FIGS. 1*a* and 1*b*.

FIG. 3 is a side view of the grounding assembly shown in FIG. 2.

FIG. 4 is a side view of the adapter and a sectional view of a portion of a typical receptacle.

FIG. 5 is a view taken along line 5—5 of FIG. 4.

FIG. 6 is a sectional view taken along the line 6—6 of FIG. 4.

FIG. 7 is a sectional view taken along line 7—7 of FIG. 4.

FIG. 8 is a sectional view taken along line 8—8 of FIG. 6.

DETAILED DESCRIPTION

Referring to FIG. 1*a*, a grounding electrical adapter 10 embodying the invention has openings 12, 14 and 16 at its back end and blades 16 and 18 extending forwardly of its front end. A three-blade plug 20 can be plugged into the back end of the adapter 10 by inserting the powerline blades 22 and 24 and the grounding blade 26 of the plug into the openings 12, 14 and 16 respectively of the adapter. The blades 16 and 18 of the adapter 10 can be inserted into the corresponding slots 28 and 30 of the outlet socket 32 of a receptacle 34, which has a cover plate 36 secured to an electrically grounded portion (not shown) thereof by a removable metal screw 36, which is offset from the socket 32 by a selected distance along the plate 36. In use, the adapter 10 is plugged into the outlet socket 32 of the receptacle 34 to make electrical contact between the blades 16 and 18 of the adapter and the corresponding female terminals (not shown) behind the socket slots 28 and 30 respectively, and a grounding assembly of adapter 10 is moved from an inoperative position to an operative position such that a grounding terminal 38 thereof slides under the head of the previously loosened, but not removed, grounded screw 36. The grounded screw 36 is then tightened to press the terminal 38 against the plate 36, and the adapter is ready for use with a grounding plug 20 plugged into its back end.

Referring to FIG. 1*b*, the adapter 10 comprises a back body portion 40 and a front body portion 42, each made of an electrically insulating material. The back body portion 40 is cup-shaped, closed at its back end except for the openings 12, 14 and 16, and open at its front end, and has an internal rib structure providing mechanical strength and providing certain channeling and mating functions described below. Similarly, the front body portion 42 is cup-shaped, closed at its front end except for two openings 43 and 44 from which the blades 16 and 18 extend and for a central opening 46 for a fastener 48, and open at its back end. The front body portion 42 has a similar internal rib structure. The adapter blades 16 and 18 are made of metal and have back portions **16*a* and 18*a* which are closer to each other than the blades 16 and 18, and have respective leaf springs 16*b* and 18*b* attached thereto with respective rivets 16*c* and 18*c* to extend along the back portions 16*a* and 18*a* respectively, and to be biased against them. The back end of the back portion 16*a* is bevelled toward the leaf spring 16*b* and the back end of the spring 16*b* curves away from the back portion 16*a*, the bevelling and curving serving to facilitate the insertion of a corresponding blade 22 between the spring 16*b* and the back portion 16*a*, in line with the blade 16. Similarly, the back end of the back portion 18*a* is bevelled toward the spring 18*b* and the back end of the spring 18*b* curves away from the portion 18*a* to facilitate the insertion of a blade 24 between the portion 18*a* and the spring 18*b*, in line with the blade 18.**

The grounding terminal 38 is a part of a grounding assembly 50 which is entirely made of metal and which, as best seen in FIGS. 1*b*, 2 and 3, comprises a flat ring 52, an integral segment 54 extending radially inwardly from the ring 52 and ending in a centrally located inner ring 56 having a central opening 58, and an integral handle 60 extending radially outwardly of the ring 52. The grounding terminal 38 is a plate which is integral with the handle 60 and extends from the handle 60 tangentially of the ring 52. The grounding terminal 38 has a semicircular opening **38*a* at its free end, and is in a plane parallel to that of the ring 52 but disposed forwardly thereof at about the level (or slightly forwardly of the level) of the front end of the front body portion 42. A metal female terminal 62 is secured to the segment 54 of the grounding assembly 50 by a metal rivet 64, extends backwardly of the ring 52 and opens toward the back of the adapter 10. The female terminal 62 is U-shaped and has legs 66 and 68 which converge toward each other for most of their length but have back ends 66*a* and 68*a* which diverge from each other in going back, so as to facilitate the insertion of a grounding blade 24 between the legs 66 and 68, and, as described below, to pivot, if need be, the grounding assembly 50 from an inoperative position to an operative position as the plug 20 is plugged into the adapter 10.**

In the assembled adapter 10, the components are arranged in the relative positions indicated in FIG. 1*b*. The blades 16 and 18 pass through the open portion of the ring 52 of the grounding assembly 50 and through the respective openings 43 and 44 of the front body portion 42, the back portions **16*a* and 18*a* of the blades 16 and 18 are guided by suitable guides in the internal rib structure of the back body portion 40 to be aligned with the respective openings 12 and 14 thereof, and the fastener 48 passes through the openings 46 of the front body portion 42 and through the central opening 58 of the grounding assembly 50, and is screwed or driven into the opening 70 of the back body portion 40. Referring to FIG. 8, the opening 46 has a recessed larger portion 46*a* to accommodate the head 48*a* of the fastener 48, and the opening 70 in the back body portion 40 has a threaded portion 70*a* at its back end matching a threaded portion 48*b* at the back end of the fastener 48.**

Referring to FIGS. 1*b*, 7 and 8, and particularly to FIG. 7, the grounding assembly 50 fits directly behind the front body portion 42 and coaxially therewith. Its movement clockwise in FIG. 7 is limited by a stop **42*a*, which is a part of the front body portion 42, coming against the segment 54 of the grounding assembly 50. The counterclockwise (in FIG. 7) movement of the grounding assembly 50 is limited by another stop 42*b*, which is a part of the front body portion 42 and comes against the segment 54 of the grounding assembly 50. The grounding assembly 50 can freely pivot about the fastener 48 between the position shown in FIG. 7, which is referred to in the specification as the operative position, and a position in which its segment 54 is against the stop 42*b* and which is referred to in the specification as an inoperative position. The grounding assembly 50 may be able to translate slightly within the plane of its ring 52, because of some clearance between the shank of the fastener 48 and the central opening 58 of the grounding assembly 50, a slight clearance between the outer periphery of the inner ring 56 of the grounding assembly and a corresponding semicircular stop 42***c* of the front body portion 42, and a slight clearance between the inner periphery of the ring 52 and the radially outwardly periphery of the stops 42*a*, 42*b*, and 42*d* to 42*f* of the front body portion 42.

Referring to FIG. 6, the back body portion 40 has an internal rib structure including guide channels 40*a* and 40*b* for corresponding projections of the back portions 16*a* and 18*a* respectively of the adapter blades 16 and 18 (only a projection 18'*b* is visible; a correspnding projection of the back blade portion 16*b* is not visible). Additionally, as seen in FIG. 6, there is a cavity 40*c* accommodating the female terminal 62 of the grounding assembly 50, and allowing for movement of the grounding assembly 50 between its operative and its inoperative position. When the grounding assembly 50 is in its operative position, as shown in FIGS. 6 and 7, the female terminal 62 thereof is aligned with the opening 16 so as to receive the grounding blade 24 of a plug 20. The back ends of the blades 16 and 18 (the opening between the back portion 16*a* and the spring 16*b*, and the opening between the back portion 18*a* and the spring 18*b*) are at all times aligned with the openings 12 and 14 respectively of the adapter 10 to receive the blades 22 and 24 respectively of the plug 20. The internal rib structures of the front and back portions 42 and 40 mate such that the grounding assembly 50 is not pinched between them, but can rotate and perhaps translate.

In use of the grounding electrical adapter described above, the grounding assembly 50 is pivoted about the fastener 48 to come to or toward its inoperative position, and the adapter is plugged into a receptacle of the type illustrated in FIGS. 1*a* and 4. The grounded screw 36 of the receptacle has been previously loosened as illustrated in FIG. 4, or is loosened at this time, but is not removed, so as not to allow the plate 36 to move. The grounding assembly 50 is then pivoted toward its operative position, for example by grasping the handle 60 thereof and pivoting the assembly clockwise as seen in FIGS. 6 and 7, to bring it to the operative position shown in FIGS. 6 and 7, at which the shank of the loosened, but not removed, grounded screw 36 received within the opening 38 of the grounding terminal 38. The grounding screw 36 is then tightened, and the adapter is ready to have a plug 20 plugged in at its back end. Since the grounding assembly 50 is made of an electrically conductive material, and so are the blades 16 and 18, proper electrical contact is established between the female terminals of the receptacle and the powerline terminals 22 and 24 of the plug and between the grounded portion of the receptacle and the grounding blade 24 of the plug.

Note that when the grounding assembly 50 is in its inoperative position (the broken line position in FIG. 5), the curved portion 66*a* of the leg 66 is immediately in front of the opening 16 at the back side of the back body portion 40, and blocks the grounding blade 26 from insertion into the adapter for as long as the grounding assembly 50 remains in the operative position. However, if the plug 20 is forced into the adapter 10, the side of the curved portion 66*a* facing the opposite curved portion 68*a* act as a cam surface with the respect to the leading end of the grounding blade 26, and pivots the entire grounding assembly 50 clockwise in in FIG. 5, about the fastener 48, to thereby move the grounding assembly toward its operative position as the plug 20 is being forced into the adapter 10. If the grounded screw 36 is loosened, as indicated in FIG. 4, and the adapter 10 is plugged into the receptacle, with its grounding assembly in the inoperative position, and the plug 20 is then plugged into the adapter 10, this forces the grounding assembly toward its operative position and forces the grounding terminal 38 thereof in proper grounding position with respect to the grounded screw 36, i.e., in the position indicated in FIGS. 6 and 7. The grounded screw 36 can be tightened at this time to secure the grounding terminal 38 between its head and the plate 36 of the receptacle 34.

Note that the term "blade" is used in this specification to include both flat male terminals (like terminals 16 and 18) and male terminals of other shapes (such as the more round terminal 26).

I claim:

1. A grounding electrical adapter for electrically coupling a plug having two powerline male terminals and a grounding male terminal to a powerline receptacle having an outlet socket with two powerline female terminals, said receptacle having a receptacle plate secured to an electrically grounded portion of the receptacle with a removable, electrically conductive screw spaced along the plate from the socket, said adapter comprising:

an adapter body made of an electrically insulating material and having a back end with openings for receiving the male terminals of a plug when the plug is plugged into the adapter;

two adapter male terminals secured to the adapter body and extending forwardly of a front end thereof, said adapter male terminals shaped and disposed to be received and make electrical contact with the female terminals of a receptacle socket into which the adapter is plugged in;

means disposed within the adapter body and electrically connecting the adapter male terminals to the powerline male terminals of a plug plugged into the adapter; and grounding assembly means having a portion disposed within the adapter body and a portion disposed outside the adapter body, said grounding assembly means moveable between: (a) an operative position in which, when the adapter is plugged into the receptacle socket, the outside portion of the grounding assembly means is aligned with the grounded screw of the receptacle and the inside portion of the grounding assembly means makes electrical contact with the grounding male terminal of a plug plugged into the adapter; and (b) an inoperative position in which when the adapter is plugged into a receptacle, the outside portion of the grounding assembly means is offset from the grounding screw of the receptacle along a plate and the inside portion of the grounding assembly means blocks the opening for the grounding male terminal of a plug and prevents plugging in the plug into the adapter while the grounding assembly means remains in its inoperative position.

2. A grounding electrical adapter as in claim 1 wherein the portion of the grounding assembly means which blocks the opening for the grounding male terminal of the plug when the grounding assembly is in its inoperative position includes a cam surface coacting with the grounding blade of a plug being forced into the adapter to pivot the grounding assembly means from its inoperative toward its operative position.

3. A grounding electrical adapter for electrically coupling a three-wire plug having two powerline blades and a grounding blade to a two-wire receptacle having a two-slot socket where the two powerline blades of a two-wire plug can be inserted to make electrical contact with the receptacle wires, the receptacle having a grounded screw offset from the socket, comprising:

an electrically insulating adapter body having openings at a back end for plugging therein a three-wire electrical plug;

a pair of electrically conductive adapter terminal means secured to the adapter body and having (1) back ends disposed within the body and making electrical contact with the powerline blades of a plug plugged into the adapter, and (2) front ends terminating in adapter blades for plugging into the outlet socket of a two-wire receptacle for making electrical contacts with the two powerline wires thereof; and an electrically conductive grounding assembly means having a back end disposed within the adapter body and a front end disposed outside the adapter body, said grounding assembly means moveable between: (1) an operative position in which; (i) the back end thereof makes electrical contact with the grounding blade of a plug plugged into the adapter body; and (ii) the front end thereof is aligned with the grounded screw of a receptacle into whose outlet socket the adapter is plugged in; and (2) an inoperative position in which; (i) the back end of the grounding assembly means is disposed in the path of the grounding blade of a plug in the adapter to prevent the plugging in of such grounding blade while the grounding assembly remains in its inoperative position; and (ii) the front end of the grounding assembly means is offset from the grounded screw of a receptacle into which the adapter is plugged in.

4. A grounding electrical adapter for coupling a grounding blade of an electrical plug to a grounded screw of an electrical receptacle without the need to remove said grounded screw comprising:

an electrically insulating adapter body and means extending from the adapter body for securing the adapter body to the receptacle at a substantially fixed position of the adapter body with respect to the grounded screw of the receptacle;

means at a back end of the adapter body for plugging therein the grounding blade of the plug; and electrically conductive grounding assembly means secured to the adapter body for pivotal movement about a selected axis of the adapter body between (a) an operative position in which (i) a portion of the grounding assembly means is disposed outside the adapter body and is aligned with the grounded screw of the receptacle when the adapter is at said fixed position with respect thereto, and (ii) a portion of the grounding assembly means is located inside the adapter body and makes electrical contact with the grounding blade of the plug when the plug is plugged into the adapter body; and (b) an inoperative position in which (i) the outside portion of the grounding assembly means is offset from the grounded screw of the receptacle when the adapter is at said fixed position which respect thereto, and (ii) the inside portion of the grounding assembly means is disposed in the path of the grounding blade to be plugged into the adapter, the last recited portion of the grounding assembly means including a cam surface moveable by the grounding blade of a plug being plugged into the adapter to pivot the grounding assembly means from its inoperative position toward its operative position.

5. A grounding electrical adapter as in claim 4 wherein the means for securing the adapter body to the receptacle at a fixed position with respect thereto comprise a pair of male terminals extending forwardly from a front end of the adapter body and arranged for plugging into an outlet socket of the receptacle, and including means disposed within the adapter body and making electrical contact between the male terminals of the adapter and a pair of male terminals of the plug having said grounding blade and plugged into the back end of the adapter.

6. A grounding electrical adapter as in claim 5 wherein the outside portion of the grounding assembly includes a grounding terminal moving in a selected plane as the grounding assembly means moves between its operative and its inoperative position, said grounding terminal being securable to the receptacle by loosening the grounded screw of the receptacle, without needing to remove the screw, moving the grounding assembly from its inoperative to its operative position to bring said grounding terminal thereof at a location between a cover plate of the receptacle and a head of the grounded screw, and tightening the grounded screw to secure the grounding terminal between the cover plate of the receptacle and the head of the grounded screw.

* * * * *